US011085158B2

(12) United States Patent
Wang et al.

(10) Patent No.: US 11,085,158 B2
(45) Date of Patent: Aug. 10, 2021

(54) BIDIRECTIONAL SHIP LIFT BY GRAVITY BALANCING

(71) Applicants: Zhejiang Ocean University, Zhejiang (CN); Shanghai Maritime University, Shanghai (CN)

(72) Inventors: Huaming Wang, Zhejiang (CN); Shi He, Shanghai (CN); Lin Chen, Zhejiang (CN); Tao Wang, Zhejiang (CN); Junmei Liu, Zhejiang (CN); Zhenhuang Du, Zhejiang (CN); Qiaorui Wu, Zhejiang (CN)

(73) Assignees: Zhejiang Ocean University, Zhoushan (CN); Shanghai Maritime University, Shanghai (CN)

( * ) Notice: Subject to any disclaimer, the term of this patent is extended or adjusted under 35 U.S.C. 154(b) by 0 days.

(21) Appl. No.: 16/872,324

(22) Filed: May 11, 2020

(65) Prior Publication Data

US 2020/0370263 A1 Nov. 26, 2020

(30) Foreign Application Priority Data

May 20, 2019 (CN) ..... 201910417696.0

(51) Int. Cl.
*E02C 5/00* (2006.01)

(52) U.S. Cl.
CPC ..... *E02C 5/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 850,320 | A * | 4/1907 | Roeder | E02C 5/00 405/86 |
| 6,979,149 | B1 * | 12/2005 | Thompson | E02C 5/00 405/3 |
| 7,354,223 | B2 * | 4/2008 | Shelton | E02C 5/00 405/86 |
| 7,520,231 | B2 * | 4/2009 | Bishop | E02C 1/02 114/44 |
| 10,538,890 | B2 * | 1/2020 | Ma | E02C 5/00 |
| 2005/0281618 | A1 * | 12/2005 | Thompson | E02C 5/00 405/86 |
| 2007/0020050 | A1 * | 1/2007 | Shelton | E02C 1/00 405/86 |

FOREIGN PATENT DOCUMENTS

| | | | |
|---|---|---|---|
| CN | 2098492 U | * | 3/1992 |
| CN | 204311429 U | | 5/2015 |

* cited by examiner

*Primary Examiner* — Kyle Armstrong

(57) ABSTRACT

Disclosed is an energy-saving bidirectional ship lift by gravity balancing, including: a ship lift body. A first support is provided in a middle of the ship lift body. A second support is provided at a side of the first support. A third support is provided at the other side of the first support. A space between the second support and the first support forms a first shaft. A space between the first support and the third support forms a second shaft. A first ship-carrying chamber and a second ship-carrying chamber are respectively provided in the first shaft and the second shaft to allow two ships to be transported at the same time. An entry water tank and an exit water tank are provided at two sides of each ship-carrying chamber to adjust the weight of the two ship-carrying chambers.

10 Claims, 9 Drawing Sheets

BIDIRECTIONAL SHIP LIFT BY GRAVITY BALANCING

CROSS-REFERENCE TO RELATED APPLICATIONS

This application claims the benefit of priority from Chinese Patent Application No. 201910417696.0, filed on May 20, 2019. The content of the aforementioned application, including any intervening amendments thereto, is incorporated herein by reference in its entirety.

TECHNICAL FIELD

The present application relates to water conservancy and hydropower engineering and environmental technique, and more particularly to an energy-saving bidirectional ship lift by gravity balancing.

BACKGROUND OF THE INVENTION

A ship lift is a navigation construction designed to transport ships between water at two different elevations. The ship lift includes an upstream lock head, a downstream lock head, a ship-carrying chamber, a support-oriented structure and a driving device, and is an alternative to a vertical ship lift and an inclined ship lift.

However, there are no two ship-carrying chambers that are symmetrically provided in the vertical ship lift and the inclined ship lift in the prior art. Only one ship can be raised or lowered at a time, resulting in a low navigation efficiency. Moreover, the vertical ship lifts consume huge electric energy to raise and lower the ship-carrying chambers and the ships, and are not provided with screw nuts and screws to realize self-locking, lacking the safety and stability.

Thus, in order to optimize the ship life with increased efficiency, reduced electric power consumption and improved safety, it is required to develop an energy-saving bidirectional ship lift by gravity balancing.

SUMMARY OF THE INVENTION

Given above, this application aims to overcome problems that existing ship lifts have low ship-transporting efficiency, high electric power consumption and poor safety and stability. The application provides an energy-saving bidirectional ship lift by gravity balancing, which has increased efficiency, reduced electric power consumption and improved safety.

The technical solution is described below to solve the technical problems mentioned above.

An energy-saving bidirectional ship lift by gravity balancing, comprising: a ship lift body;

wherein a first support is provided in a middle of the ship lift body; a second support is provided at a side of the first support; and a third support is provided at the other side of the first support;

a downstream approach channel is provided at a bottom of a side of the second support and a bottom of a side of the third support, respectively; and an upstream approach channel is provided at a top of a side of the second support and a top of a side of the third support, respectively;

a space between the second support and the first support forms a first shaft; a space between the first support and the third support forms a second shaft; a first ship-carrying chamber is provided in the first shaft; a second ship-carrying chamber is provided in the second shaft; and two transition ship chambers are respectively provided at a top of the first shaft and a top of the second shaft;

a top of the third support is provided with a first outer safety pincer installation groove, in which a plurality of first outer safety pincers are provided; a bottom of each first outer safety pincer is provided with a first outer fixed pulley; and a top of each first outer safety pincer is provided with a second outer fixed pulley;

a top of the second support is provided with a second outer safety pincer installation groove, in which a plurality of second outer safety pincers are provided; a bottom of each second outer safety pincer is provided with a sixth outer fixed pulley; and a top of each second outer safety pincer is provided with a fifth outer fixed pulley;

a top of the first support is provided with a tension device installation groove; a plurality of first inner fixed pulleys are provided at a bottom of a side of the tension device installation groove; and a plurality of fifth inner fixed pulleys are provided at a bottom of the other side of the tension device installation groove;

a bottom of each first inner fixed pulley is provided with a first inner safety pincer; and a bottom of each fifth inner fixed pulley is provided with a second inner safety pincer;

a second inner fixed pulley is provided at the bottom of the side of the tension device installation groove; and a plurality of bidirectional speed limiters are provided at the bottom of the other side of the tension device installation groove;

a top of the tension device installation groove is provided with an outer tension gear installation groove; a plurality of fourth outer fixed pulleys are provided at a bottom of a side of the outer tension gear installation groove; a plurality of third outer fixed pulleys are provided at a bottom of the other side of the outer tension gear installation groove; and a plurality of outer tension gears are provided in the outer tension gear installation groove; and an inner tension gear installation groove is provided at a bottom of the tension device installation groove; a plurality of third inner fixed pulleys are provided at a top of a side of the inner tension gear installation groove; a plurality of fourth inner fixed pulleys are provided at a top of the other side of the inner tension gear installation groove; and a plurality of inner tension gears are provided in the inner tension gear installation groove.

In an embodiment, a top of each outer tension gear is fixedly connected to an outer tension gear installation plate via bolts; an end of each of a plurality of first tension hydraulic cylinders is fixedly connected to a top of the outer tension gear installation plate; and the other end of each of the plurality of first tension hydraulic cylinders is fixedly connected to a top of the outer tension gear installation groove; and a bottom of each inner tension gear is fixedly connected to an inner tension gear installation plate via bolts; an end of each of a plurality of second tension hydraulic cylinders is fixedly connected to a bottom of the inner tension gear installation plate; and the other end of each of the plurality of second tension hydraulic cylinders is fixedly connected to a bottom of the inner tension gear installation groove.

In an embodiment, a plurality of trapezoidal screw installation grooves are provided at two sides of the first shaft and two sides of the second shaft, respectively; and each of a plurality of linear slide rail installation grooves is sandwiched between two adjacent trapezoidal screw installation grooves; and a plurality of trapezoidal screws are provided in the trapezoidal screw installation grooves; a plurality of screw motors are respectively provided at an end of each of the plurality of trapezoidal screws and are electrically connected to an external power supply; and linear slide rails are respectively provided in the linear slide rail installation grooves.

In an embodiment, a plurality of first outer holes are provided at a side of a top of the first ship-carrying chamber; and a plurality of first inner holes are provided at the other side of the top of the first ship-carrying chamber;

a plurality of second outer holes are provided at a side of a top of the second ship-carrying chamber; and a plurality of second inner holes are provided at the other side of the top of the second ship-carrying chamber; and the first outer holes, the first inner holes, the second outer holes and the second inner holes are provided for fixing steel cables.

In an embodiment, an end of each of a plurality of outer steel cables is fixedly connected to one of the second outer holes; and the other end of each outer steel cable passes through the first outer fixed pulley, one of the first outer safety pincers, the second outer fixed pulley, one of the third outer fixed pulleys, one of the outer tension gears, one of the fourth outer fixed pulleys, the fifth outer fixed pulley, one of the second outer safety pincers and the sixth outer fixed pulley in sequence, and then is fixedly connected to one of the first outer holes.

In an embodiment, an end of each of a plurality of inner steel cables is fixedly connected to one of the first inner holes; and the other end of each inner steel cable passes through the first inner safety pincer, one of the first inner fixed pulleys, the second inner fixed pulley, one of the third inner fixed pulleys, one of the inner tension gears, one of the fourth inner fixed pulleys, one of the bidirectional speed limiters, one of the fifth inner fixed pulleys, the second inner safety pincer in sequence and then is fixedly connected to one of the second inner holes.

In an embodiment, a middle of the first ship-carrying chamber and a middle of the second ship-carrying chamber are respectively provided with a main ship chamber; an entry water tank is provided at a side of the main ship chamber; and an exit water tank is provided at the other side of the main ship chamber;

a first entry flap gate is provided at a side of the entry water tank; and a second entry flap gate is provided at the other side of the entry water tank;

a first exit flap gate is provided at a side of the exit water tank; and a second exit flap gate is provided at the other side of the exit water tank;

a retractable block is provided at an outer side of the first entry flap gate, the second entry flap gate, the first exit flap gate and the second exit flap gate, respectively;

a barrier is provided at an inner side of the first entry flap gate, the second entry flap gate, the first exit flap gate and the second exit flap gate, respectively;

a plurality of water inlets are spacedly provided at a top of two sides of the entry water tank and a top of two sides of the exit water tank, respectively; and a plurality of water outlets are spacedly provided at a bottom of two sides of an inner wall of the entry water tank and a bottom of two sides of an inner wall of the exit water tank, respectively; and an anti-collision rubber is provided at two sides of an inner wall of the main ship chamber, respectively; and a standard waterline is provided on an outer surface of the anti-collision rubber.

In an embodiment, a plurality of screw nuts are spacedly provided at two sides of an outer wall of the first ship-carrying chamber and two sides of an outer wall of the second ship-carrying chamber; and each of a plurality of linear sliders is sandwiched between two adjacent screw nuts; and the screw nuts are threaded with the trapezoidal screws; and the linear sliders are in clearance fit with linear slide rails.

In an embodiment, a plurality of tension sensors are respectively provided at bottoms of the first outer holes, the second outer holes, the first inner holes and the second inner holes;

two ends of each of a plurality of inner steel cables and two ends of each of a plurality of outer steel cables are fixedly connected to the tension sensors; eight speed sensors are respectively provided at four corners of the first ship-carrying chamber and four corners of the second ship-carrying chamber; eight acceleration sensors are respectively provided beside the eight speed sensors; eight lidar ranging sensors are respectively provided beside the eight acceleration sensors; and the eight speed sensors, the eight acceleration sensors, the eight lidar ranging sensors and the tension sensors are electrically connected to an external central control computer; and a plurality of water inlets and a plurality of water outlets are fixedly connected to an external water pump through water pipes; and a plurality of first tension hydraulic cylinders and a plurality of second tension hydraulic cylinders are fixedly connected to an external oil pump through oil pipes.

In an embodiment, a transitional main ship chamber is provided in a middle of each of the two transition ship chambers; two entry chutes are respectively provided at two sides of the transitional main ship chamber; two exit chutes are respectively provided at two sides of the transitional main ship chamber; and an entry gate is provided between the two entry chutes; and an exit gate is provided between the two exit chutes.

Compared to the prior art, this application has the following benefits.

(1) The application provides an energy-saving bidirectional ship lift by gravity balancing, and a first ship-carrying chamber and a second ship-carrying chamber are symmetrically provided in a middle of a first shaft and a middle of a second shaft to transport two ships at the same time, improving the efficiency of ships passing the dam.

(2) In the application, an entry water tank and an exit water tank are provided at two sides of the first ship-carrying chamber, and an entry water tank and an exit water tank are provided at two sides of the second ship-carrying chamber, so that the first ship-carrying chamber and the second ship-carrying chamber are dynamically adjusted in weight and move due to gravitational potential energy, thereby raising and lowering the ships and saving energy.

(3) Through the adjustment of first tension hydraulic cylinders and second tension hydraulic cylinders, the ship lift of the application can adapt to varying differences in elevation between upstream and downstream in different seasons, broadening application ranges of the ship lift.

(4) Linear slide rails are respectively provided in the linear slide rail installation grooves to guide the first and second ship-carrying chambers to move on an even keel.

(5) The ship lift is provided with screw nuts and trapezoidal screws which cooperate with each other to realize self-locking when the ship lift fails, thereby protecting the first and second ship-carrying chambers.

Not all these effects are required in implementing the application.

BRIEF DESCRIPTION OF THE DRAWINGS

This application will be understandable with reference to the accompanying drawings constituting a part of this application. Exemplary embodiments and illustrations are intended to explain the present application without limiting.

Figure 1:
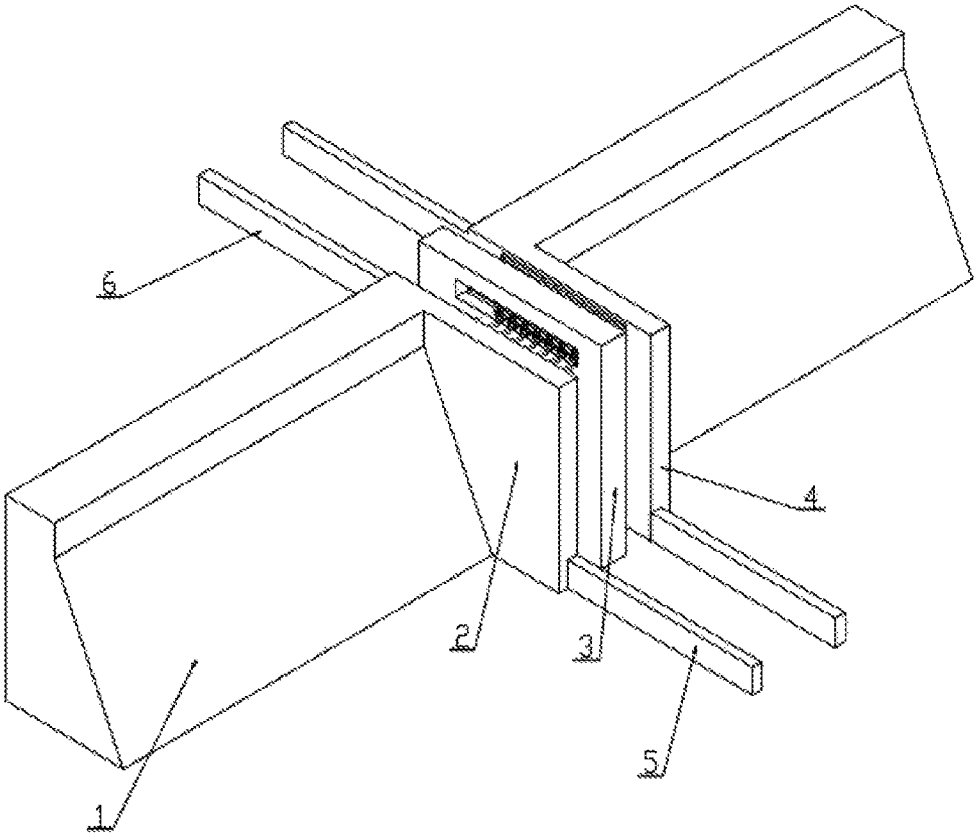
FIG. 1 is a schematic diagram of an energy-saving bidirectional ship lift by gravity balancing according to an embodiment of the present application.

In the drawings: 1, ship lift body; 2, second support; 3, first support; 4, third support; 5, downstream approach channel; 6, upstream approach channel; 7, first shaft; 8, second shaft; 9, first ship-carrying chamber; 10, second ship-carrying chamber; 11, second outer hole; 12, first outer fixed pulley; 13, first outer safety pincer; 14, second outer fixed pulley; 15, third outer fixed pulley; 16, outer tension gear; 17, fourth outer fixed pulley; 18, fifth outer fixed pulley; 19, second outer safety pincer; 20, sixth outer fixed pulley; 21, first outer hole; 22, first inner hole; 23, first inner fixed pulley; 24, second inner fixed pulley; 25, third inner fixed pulley; 26, inner tension gear; 27, fourth inner fixed pulley; 28, bidirectional speed limiter; 29, fifth inner fixed pulley; 30, second inner hole; 31, outer tension gear installation groove; 32, inner tension gear installation groove; 33, outer tension gear installation plate; 34, first tension hydraulic cylinder; 35, inner tension gear installation plate; 36, second tension hydraulic cylinder; 37, first outer safety pincer installation groove; 38, second outer safety pincer installation groove; 39, main ship chamber; 40, entry water tank; 41, exit water tank; 42, first inner safety pincer; 43, second inner safety pincer; 44, first entry flap gate; 45, second entry flap gate; 46, first exit flap gate; 47, second exit flap gate; 48, retractable block; 49, barrier; 50, water inlet; 51, water outlet; 52, anti-collision rubber; 53, screw nut; 54, linear slider; 55, trapezoidal screw; 56, linear slide rail; 57, tension sensor; 58, outer steel cable; 59, speed sensor; 60, acceleration sensor; 61, lidar ranging sensor; 62, trapezoidal screw installation groove; 63, linear slide rail installation groove; 64, transitional main ship chamber; 65, entry chute; 66, entry gate; 67, exit chute; 68, exit gate; 69, transition ship chamber installation hole; 70, transition ship chamber; 71, inner steel cable; 72, tension device installation groove; and 73, standard waterline.

DETAILED DESCRIPTION OF EMBODIMENTS

This application will be further described below in detail with reference to the accompanying drawings and embodiments, so that the technical solutions of the application are more understandable.

Figure 2:
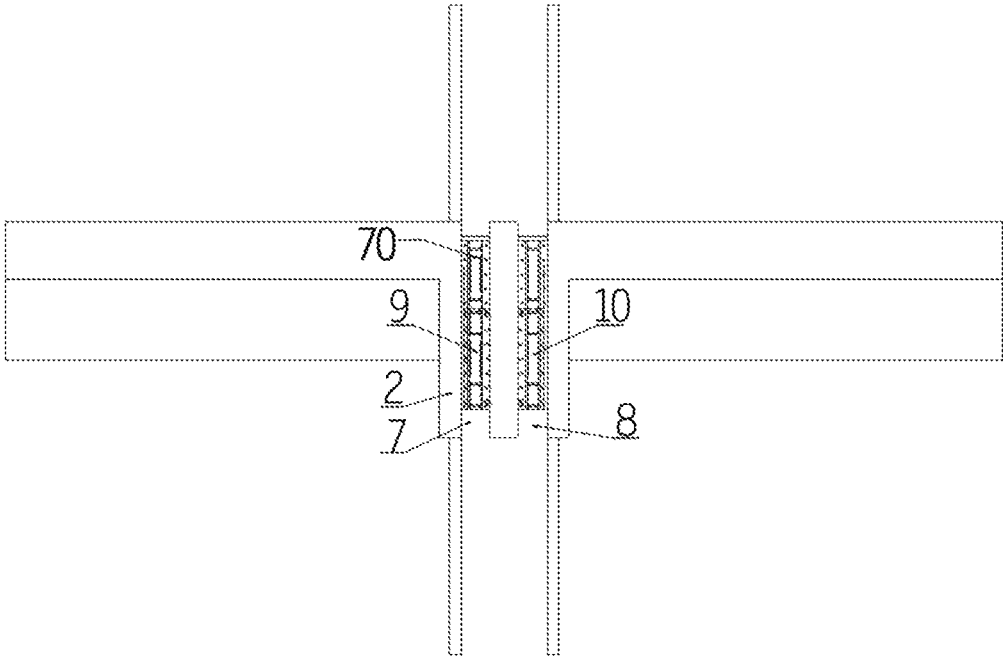
FIG. 2 is a top view of the energy-saving bidirectional ship lift by gravity balancing according to the embodiment of the present application.
Figure 3:
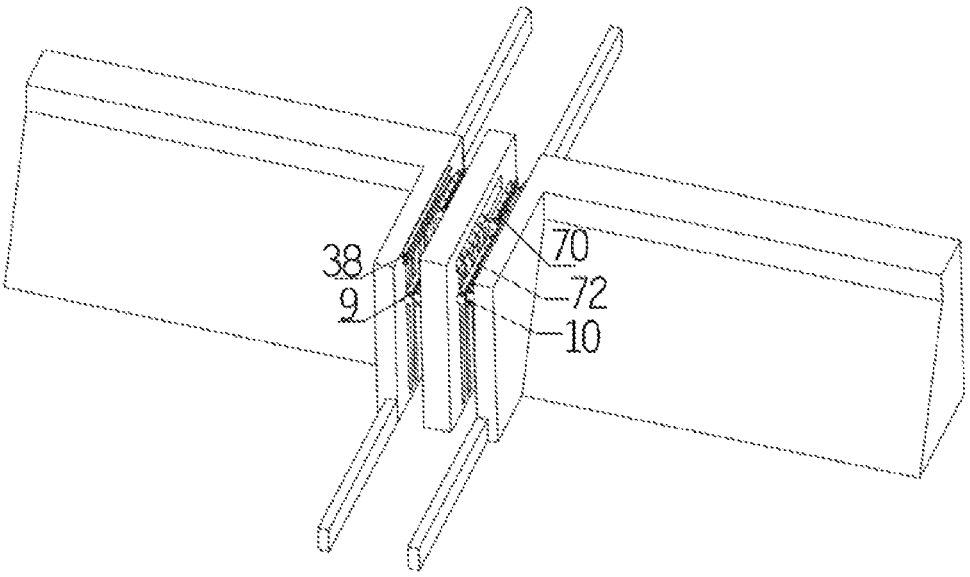
FIG. 3 is a schematic diagram of the energy-saving bidirectional ship lift by gravity balancing according to the embodiment of the present application.
Figure 4:
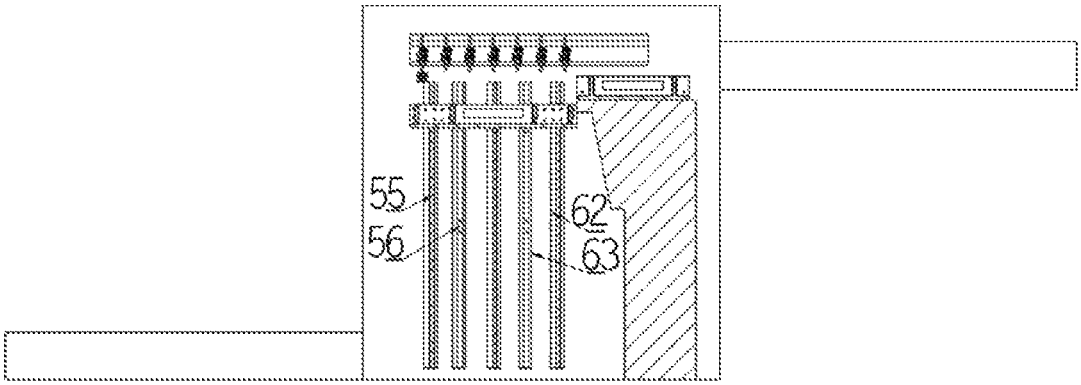
FIG. 4 is a partial cross-sectional diagram of the energy-saving bidirectional ship lift by gravity balancing according to the embodiment of the present application.
Figure 5:
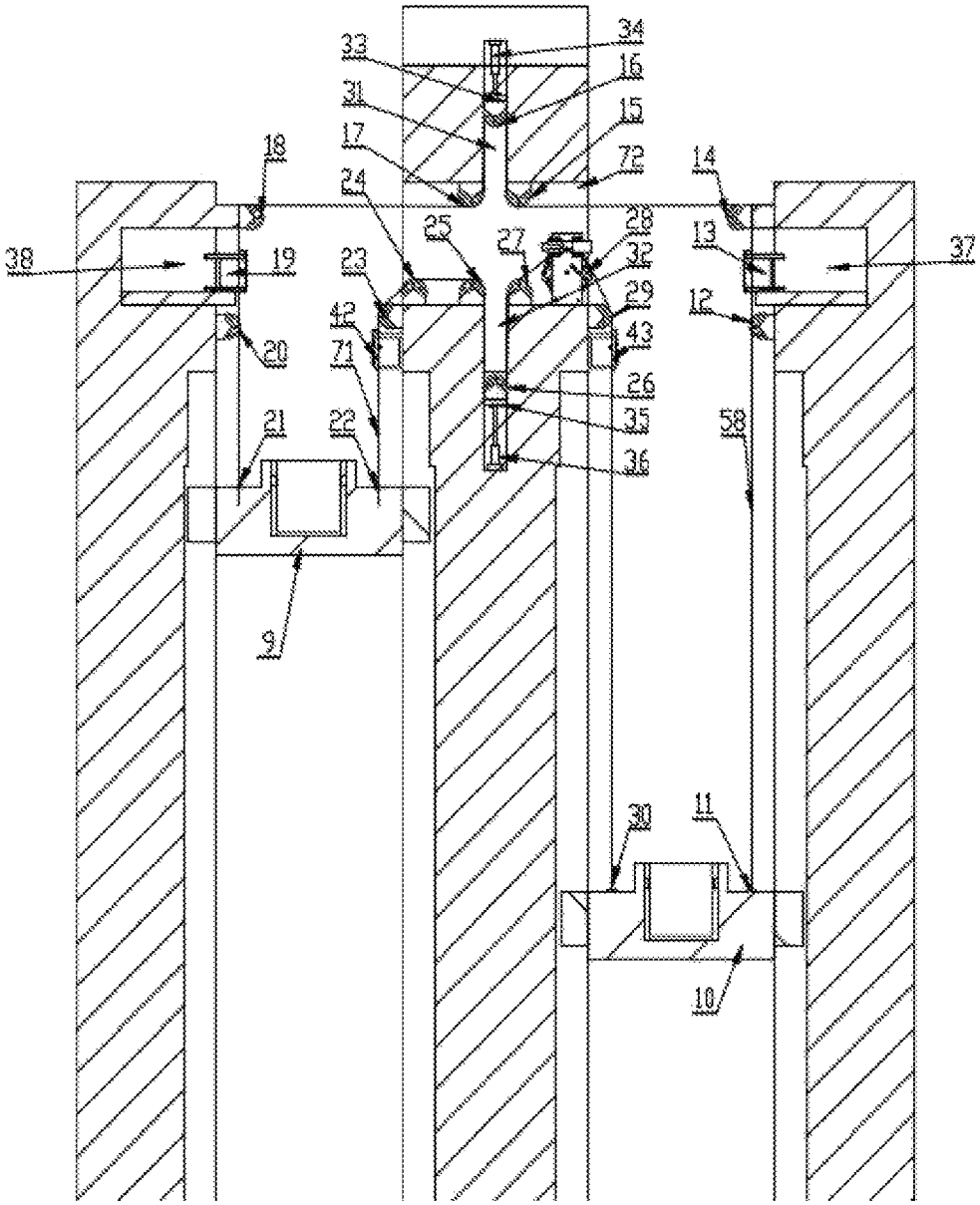
FIG. 5 is a partial cross-sectional diagram of the energy-saving bidirectional ship lift by gravity balancing according to the embodiment of the present application.
Figure 6:
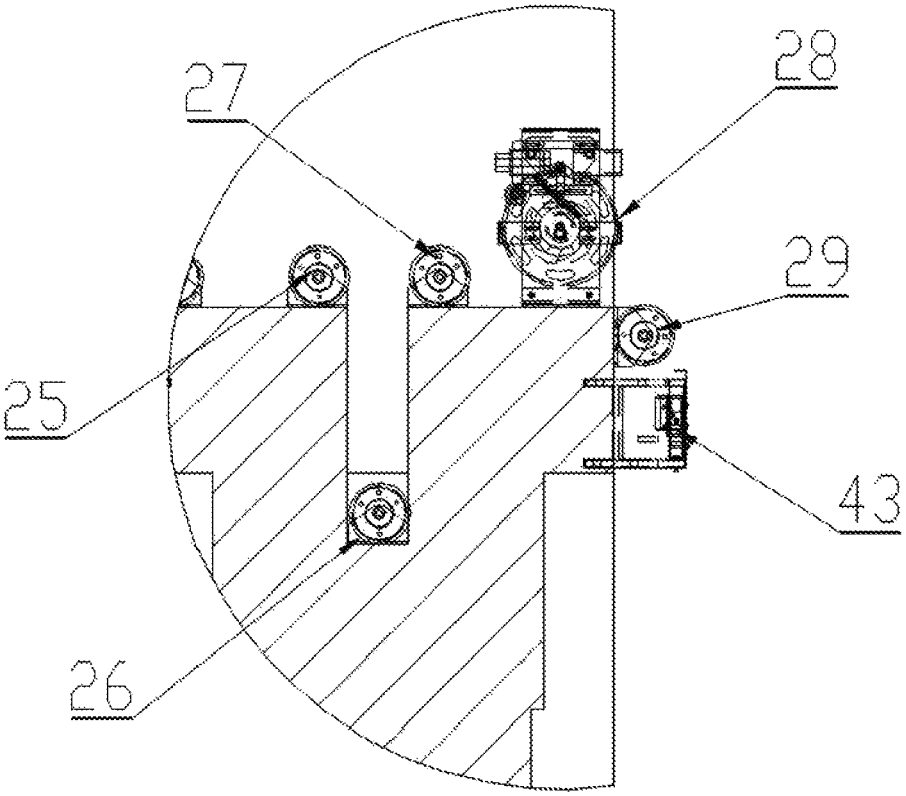
FIG. 6 is a partial cross-sectional diagram of the energy-saving bidirectional ship lift by gravity balancing according to the embodiment of the present application.
Figure 7:
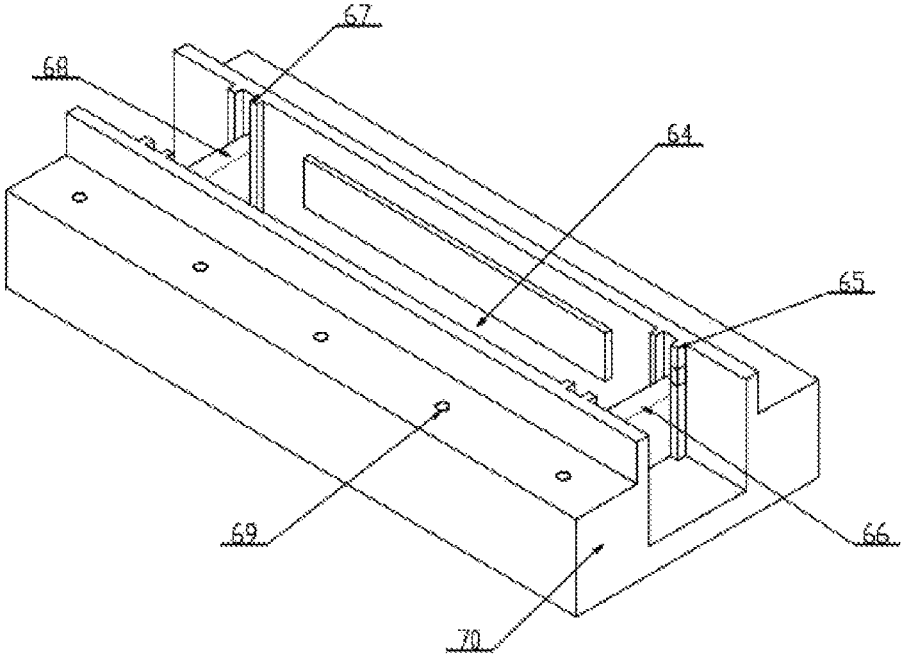
FIG. 7 is a partial view showing the energy-saving bidirectional ship lift by gravity balancing according to the embodiment of the present application.
Figure 8:
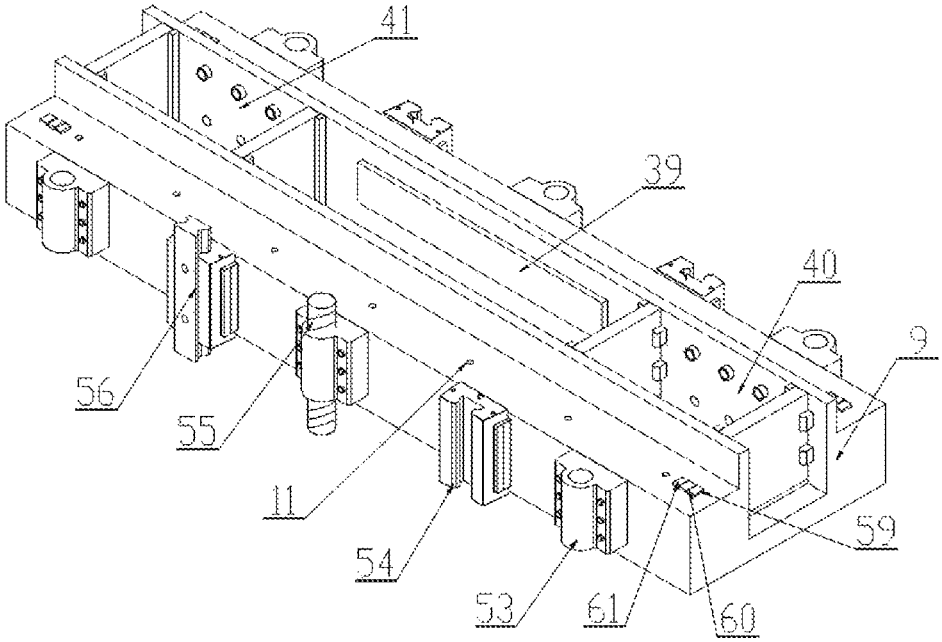
FIG. 8 is a partial view showing the energy-saving bidirectional ship lift by gravity balancing according to the embodiment of the present application.
Figure 9:
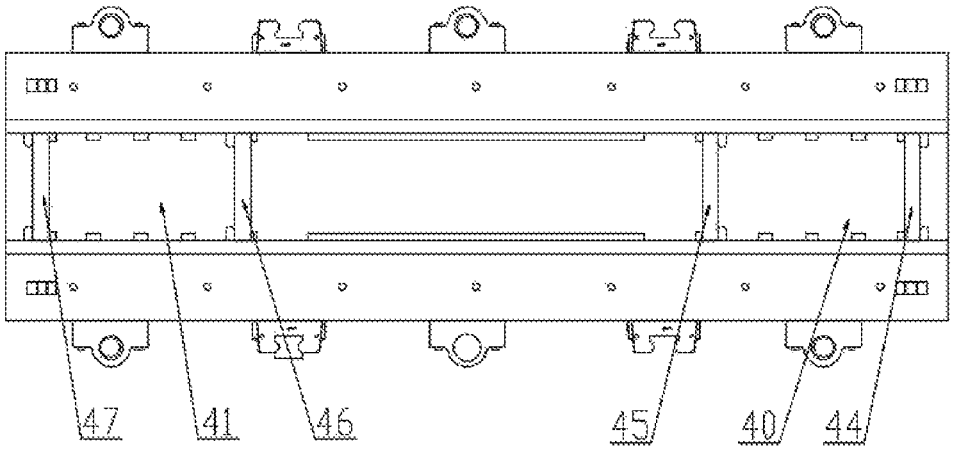
FIG. 9 is a partial view showing the energy-saving bidirectional ship lift by gravity balancing according to the embodiment of the present application.
Figure 10:
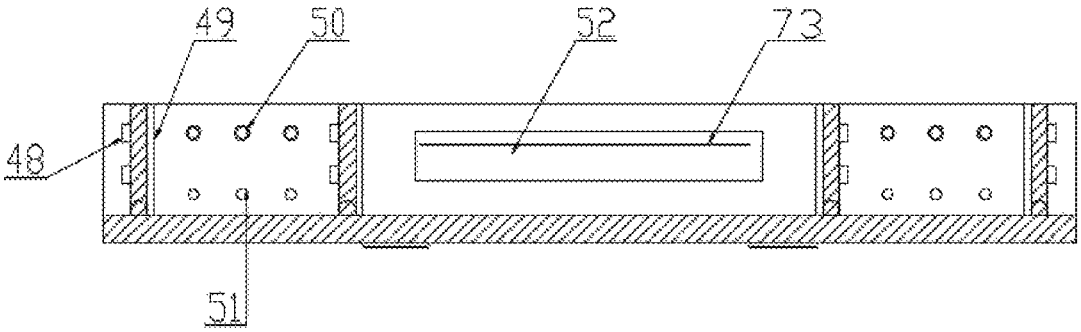
FIG. 10 is a partial cross-sectional diagram of the energy-saving bidirectional ship lift by gravity balancing according to the embodiment of the present application.
Figure 11:
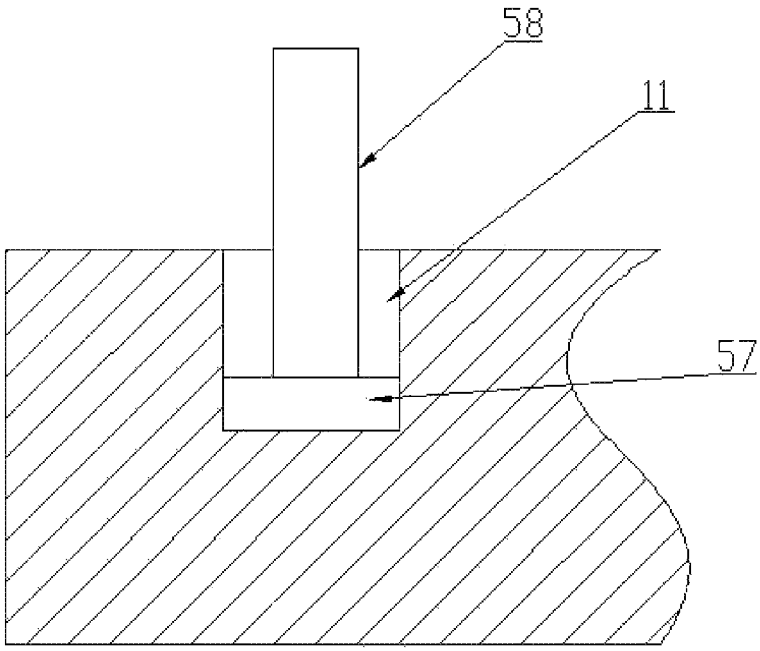
FIG. 11 is a partial cross-sectional diagram of the energy-saving bidirectional ship lift by gravity balancing according to the embodiment of the present application.

As shown in FIGS. 1-11, the application provides an energy-saving bidirectional ship lift by gravity balancing, including: a ship lift body 1, where a first support 3 is provided in a middle of the ship lift body 1. A second support 2 is provided at a side of the first support 3. A third support 4 is provided at the other side of the first support 3.

A downstream approach channel 5 is provided at a bottom of a side of the second support 2 and a bottom of a side of the third support 4, respectively. An upstream approach channel 6 is provided at a top of a side of the second support 2 and a top of a side of the third support 4, respectively.

A space between the second support 2 and the first support 3 forms a first shaft 7. A space between the first support 3 and the third support 4 forms a second shaft 8. A first ship-carrying chamber 9 is provided in the first shaft 7. A second ship-carrying chamber 10 is provided in the second shaft 7. Two transition ship chambers 70 are respectively provided at a top of the first shaft 7 and a top of the second shaft 8.

A top of the third support 4 is provided with a first outer safety pincer installation groove 37, in which a plurality of first outer safety pincers 13 are provided. A bottom of each first outer safety pincer 13 is provided with a first outer fixed pulley 12. A top of each first outer safety pincer 13 is provided with a second outer fixed pulley 14.

A top of the second support 2 is provided with a second outer safety pincer installation groove 38, in which a plurality of second outer safety pincers 19 are provided. A bottom of each second outer safety pincer 19 is provided with a sixth outer fixed pulley 20. A top of each second outer safety pincer 19 is provided with a fifth outer fixed pulley 18.

A top of the first support 3 is provided with a tension device installation groove 72. A plurality of first inner fixed pulleys 23 are provided at a bottom of a side of the tension device installation groove 72. A plurality of fifth inner fixed pulleys 29 are provided at a bottom of the other side of the tension device installation groove 72.

A bottom of each first inner fixed pulley 23 is provided with a first inner safety pincer 42. A bottom of each fifth inner fixed pulley 29 is provided with a second inner safety pincer 43.

A second inner fixed pulley 24 is provided at the bottom of the side of the tension device installation groove 72. A plurality of bidirectional speed limiters 28 are provided at the bottom of the other side of the tension device installation groove 72.

A top of the tension device installation groove 72 is provided with an outer tension gear installation groove 31. A plurality of fourth outer fixed pulleys 17 are provided at a bottom of a side of the outer tension gear installation groove 31. A plurality of third outer fixed pulleys 15 are provided at a bottom of the other side of the outer tension gear installation groove 31. A plurality of outer tension gears are provided in the outer tension gear installation groove.

An inner tension gear installation groove is provided at a bottom of the tension device installation groove. A plurality of third inner fixed pulleys 25 are provided at a top of a side of the inner tension gear installation groove 32. A plurality of fourth inner fixed pulleys 27 are provided at a top of the other side of the inner tension gear installation groove 32. A plurality of inner tension gears are provided in the inner tension gear installation groove.

In some embodiments, a top of each outer tension gear 16 is fixedly connected to an outer tension gear installation plate 33 via bolts. An end of each of a plurality of first tension hydraulic cylinders 34 is fixedly connected to a top of the outer tension gear installation plate 33. The other end of each of the plurality of first tension hydraulic cylinders 34 is fixedly connected to a top of the outer tension gear installation groove 31.

A bottom of each inner tension gear 26 is fixedly connected to an inner tension gear installation plate 35 via bolts. An end of each of a plurality of second tension hydraulic cylinders 36 is fixedly connected to a bottom of the inner tension gear installation plate 35. The other end of each of the plurality of second tension hydraulic cylinders 36 is fixedly connected to a bottom of the inner tension gear installation groove 32. Thus, the ship lift is able to adapt to varying differences in elevation between upstream and downstream in different seasons, broadening application ranges of the ship lift.

In some embodiments, a plurality of trapezoidal screw installation grooves 62 are provided at two sides of the first shaft 7 and two sides of the second shaft 8, respectively. Each of a plurality of linear slide rail installation grooves 63 is sandwiched between two adjacent trapezoidal screw installation grooves 62. A plurality of trapezoidal screws are provided in the trapezoidal screw installation grooves 62. A plurality of screw motors are respectively provided at an end of each of the plurality of trapezoidal screws 55 and are electrically connected to an external power supply. Linear slide rails 56 are respectively provided in the linear slide rail installation grooves 63, guiding the first and second ship-carrying chambers to move on an even keel.

In some embodiments, a plurality of first outer holes 21 are provided at a side of a top of the first ship-carrying chamber 9. A plurality of first inner holes 22 are provided at the other side of the top of the first ship-carrying chamber 9.

A plurality of second outer holes 11 are provided at a side of a top of the second ship-carrying chamber 10. A plurality of second inner holes 30 are provided at the other side of the top of the ship-carrying chamber 10. The first outer holes 21, the first inner holes 22, the second outer holes 11 and the second inner holes 30 are provided for fixing steel cables. These arrangements allow the first ship-carrying chamber 9 and the second ship-carrying chamber 10 to be evenly stressed.

In some embodiments, an end of each of a plurality of outer steel cables 58 is fixedly connected to one of the second outer holes 11.

The other end of each outer steel cable 58 passes through the first outer fixed pulley 12, one of the first outer safety pincers 13, the second outer fixed pulley 14, one of the third outer fixed pulleys 15, one of the outer tension gears 16, one of the fourth outer fixed pulleys 17, the fifth outer fixed pulley 18, one of the second outer safety pincers 19 and the sixth outer fixed pulley 20 in sequence and then is fixedly connected to one of the first outer holes 21, so that the second outer safety pincers 19 and the first outer safety pincers 13 can clamp the outer steel cables 58 to restrict the movement of the outer steel cables 58.

In some embodiments, an end of each of a plurality of inner steel cables 71 is fixedly connected to one of the first inner holes 22.

The other end of each inner steel cable 71 passes through the first inner safety pincer 42, one of the first inner fixed pulleys 23, the second inner fixed pulley 24, one of the third inner fixed pulleys 25, one of the inner tension gears 26, one of the fourth inner fixed pulleys 27, one of the bidirectional speed limiters 28, one of the fifth inner fixed pulleys 29, the second inner safety pincer 43 in sequence and then is fixedly connected to one of the second inner holes 30, so that the first inner safety pincer 42 and the second inner safety pincer 43 can clamp the inner steel cables 71 to restrict a movement of the inner steel cables 71.

In some embodiments, a main ship chamber 39 is provided in a middle of the first ship-carrying chamber 9 and a middle of the second ship-carrying chamber 10, respectively. An entry water tank 40 is provided at a side of the main ship chamber 39. An exit water tank 41 is provided at the other side of the main ship chamber 39.

A first entry flap gate 44 is provided at a side of the entry water tank 40. A second entry flap gate 45 is provided at the other side of the entry water tank 40.

A first exit flap gate 46 is provided at a side of the exit water tank 41. A second exit flap gate 47 is provided at the other side of the exit water tank 41.

A retractable block 48 is provided at an outer side of the first entry flap gate 44, the second entry flap gate 45, the first exit flap gate 46 and the second exit flap gate 47, respectively.

A barrier 49 is provided at an inner side of the first entry flap gate 44, the second entry flap gate 45, the first exit flap gate 46 and the second exit flap gate 47, respectively.

A plurality of water inlets 50 are spacedly provided at a top of two sides of the entry water tank 40 and a top of two sides of the exit water tank 41, respectively. A plurality of water outlets 51 are spacedly provided at a bottom of two sides of an inner wall of the entry water tank 40 and a bottom of two sides of an inner wall of the exit water tank 41, respectively.

An anti-collision rubber 52 is provided at two sides of an inner wall of the main ship chamber 39, respectively. A standard waterline 73 is provided on an outer surface of the anti-collision rubber. These arrangements ensure the safety of ships in the first ship-carrying chamber 9 and the second ship-carrying chamber 10 and convert gravity potential energy into motional potential energy for saving energy.

In some embodiments, a plurality of screw nuts 53 are spacedly provided at two sides of an outer wall of the first ship-carrying chamber 9 and two sides of an outer wall of the second ship-carrying chamber 10. Each of a plurality of linear sliders 54 is sandwiched between two adjacent screw nuts 53. The screw nuts 53 are threaded with the trapezoidal screws 55. The linear sliders 54 are in clearance fit with the linear slide rails 56 to realize self-locking of the screw nuts 53 and the trapezoidal screws 55 when the ship lift fails, thereby protecting the first and second ship-carrying chambers.

In some embodiments, a plurality of tension sensors 57 are respectively provided at bottoms of the first outer holes 21, the second outer holes 11, the first inner holes 22 and the second inner holes 30.

Two ends of each of the plurality of inner steel cables 71 and two ends of each of the plurality of outer steel cables 58 are fixedly connected to the tension sensors 57. Eight speed sensors 59 are respectively provided at four corners of the first ship-carrying chamber 9 and four corners of the second ship-carrying chamber 10. Eight acceleration sensors 60 are respectively provided beside the eight speed sensors 59. Eight lidar ranging sensors 61 are respectively provided beside the eight acceleration sensors 60. The eight speed sensors 59, the eight acceleration sensors 60, the eight lidar ranging sensors 61 and the tension sensors 57 are electrically connected to an external central control computer.

The water inlets 50 and the water outlets 51 are fixedly connected to an external water pump through water pipes. The plurality of first tension hydraulic cylinders 34 and the plurality of second tension hydraulic cylinders 36 are fixedly connected to an external oil pump through oil pipes. These arrangements realize the detection of tensile forces of the outer steel cables 58 and the inner steel cables 71 as well as the speed, acceleration and distance of the first ship-carrying chamber 9 and the second ship-carrying chamber 10, improving the ship lift safety.

In some embodiments, a transitional main ship chamber 64 is provided in a middle of each of the two transition ship chambers 70. Two entry chutes 65 are respectively provided at two sides of the transitional main ship chamber 64. Two exit chutes 67 are respectively provided at two sides of the transitional main ship chamber 64. An entry gate 66 is provided between the two entry chutes 65, and an exit gate 68 is provided between the two exit chutes 67. These arrangements offer a buffering for ships, thereby further improving the ship lift safety.

The following are processes of using the energy-saving bidirectional ship lift by gravity balancing of the application. Due to the varying differences in elevation between upstream and downstream in different seasons, before the ship lift is switched on, operators are required to respectively control, through the external central control computer, the first tension hydraulic cylinders 34 and the second tension hydraulic cylinders 36 to allow the first tension hydraulic cylinders 34 and the second tension hydraulic cylinders 36 to move synchronously, so that the outer steel cables 58 and the inner steel cables 71 are adjusted to have an appropriate length in the first and second shafts to allow a standard waterline in the first ship-carrying chamber 9 and an upstream water surface to be coincident and allow a standard waterline in the second ship-carrying chamber 10 and a downstream water surface to be coincident. When the ship lift is required to raise a ship and lower another ship simultaneously, firstly, the operators control the external central control computer to sequentially open the exit gate 68 and the entry gate 66 on both sides of the transition ship chamber 70, and then control the first outer safety pincers 13 and the second outer safety pincers 19 to clamp the outer steel cables 58, and control the first inner safety pincer 42 and the second inner safety pincer 43 to clamp the inner steel cables 71, and subsequently turn off the screw motors and lock the trapezoidal screws 55 in the trapezoidal screw installation grooves 62. At this time, the trapezoidal screws 55 and the screw nuts 53 realize self-locking, and the outer steel cables 58 and the inner steel cables 71 are clamped, so that the first ship-carrying chamber 9 and the second ship-carrying chamber 10 are kept stationary. Secondly, the operators control the external central control computer to sequentially open the first entry flap gate 44, the second entry flap gate 45, the first exit flap gate 46 and the second exit flap gate 47, which are provided in the first ship-carrying chamber 9 and the second ship-carrying chamber 10. After water flows into the carrying chambers and water surface is stable, the ships are respectively driven to a middle of the main ship chamber 39, and the first ship-carrying chamber 9 and the second ship-carrying chamber 10 accommodate water with the same volume followed by sequentially closing the first entry flap gate 44, the second entry flap gate 45, the first exit flap gate 46 and the second exit flap gate 47. Thirdly, the operators control the external central control computer to allow the first outer safety pincers 13 and the second outer safety pincers 19 to loosen the outer steel cables 58, and allow the first inner safety pincer 42 and the second inner safety pincer 43 to loosen the inner steel cables 71, and subsequently turn on the screw motors and open the water outlets 51 in the ship-carrying chamber at downstream, next, water in the entry water tank 40 and the exit water tank 41 provided on both sides of the ship-carrying chamber at downstream reduces. Due to gravity, the ship-carrying chamber at upstream starts to move downward, and the ship-carrying chamber at downstream starts to move upward. When speed reaches a preset value, the external central control computer opens the water outlets 51 provided in the ship-carrying chamber at upstream to discharge water. When the two ship-carrying chambers have the same weight, the water outlets 51 are closed, at this time, the two ship-carrying chambers move at a constant speed. When the ship-carrying chamber at upstream is about to reach the downstream, the water outlets 51 of the ship-carrying chamber at upstream are opened, next, water in the entry water tank 40 and the exit water tank 41 provided on both sides of the ship-carrying chamber at upstream reduces. Due to gravity, the two ship-carrying chambers start to slow down until the two ship-carrying chambers reach an end point with a speed of zero. The external central control computer controls the first outer safety pincers 13 and the second outer safety pincers 19 to clamp the outer steel cables 58, and controls the first inner safety pincer 42 and the second inner safety pincer 43 to clamp the inner steel cables 71. The screw motors stop rotating to keep the first ship-carrying chamber 9 and the second ship-carrying chamber 10 stationary. Through the external central control computer, the operators sequentially open the exit gate 68 and the entry gate 66 on both sides of the transition ship chamber 70, and then sequentially open the first exit flap gate 46, the second exit flap gate 47, the first entry flap gate 44 and the second entry flap gate 45, which are provided in the first ship-carrying chamber 9 and the second ship-carrying chamber 10. After water surface is stable, the ships are driven away from the two ship-carrying chambers. During the movement of the two ship-carrying chambers, the external central control computer controls the rotational speed of the screw motors to cooperate with the vertical movement of the two ship-carrying chambers. When the eight speed sensors 59, the eight acceleration sensors 60 and the eight lidar ranging sensors 61 detect a failure in the movement of the two ship-carrying chambers and the tension sensors 57 detect a large change in the cable tension, the external central control computer turns off the screw motors and performs self-locking of the trapezoidal screw 55 and the screw nut 53, and controls the first outer safety pincers 13 and the second outer safety pincers 19 to clamp the outer steel cables 58, and controls the first inner safety pincer 42 and the second inner safety pincer 43 to clamp the inner steel cables 71, so that the first ship-carrying chamber 9 and the second ship-carrying chamber 10 are kept stationary, thereby effectively reducing the occurrence of accidents and improving the ship lift safety.

In the case that some words in the description and the appended claims are used to refer to specific components, those skilled in the art should understand that hardware manufacturers may use different terms to refer to the same component. Components in the description and the appended claims are distinguished through functional differences instead of naming difference. The terms "including" and "comprising" in the specification and the appended claims are open-ended and should be interpreted as "including but not limited to". The term "approximately" implies an acceptable error range, those skilled in the art can solve the technical problems within a certain error range and basically achieve the technical effects. In addition, the term "coupling" includes any direct and indirect electrical coupling means. Therefore, the description "a first device is coupled to a second device" in the application should be understood as "the first device can be directly electrically coupled to the second device, or indirectly electrically coupled to the second device through other devices or coupling means". Described above are some preferred embodiments of the application, which are intended to illustrate general principles of the present application and are not intended to limit the scope of the application. The scope of the application is defined by the appended claims.

It should be noted that the terms "including", "comprising" or any other variations thereof are intended to cover non-exclusive inclusions, so that products or systems include not only a series of elements, but also other elements that are not explicitly listed and inherent elements that pertain to the products or systems. Without more restrictions, the expression "include a . . . " cannot be considered as a limit since other equivalent elements of the products or the systems can also acceptable.

The above are some preferred embodiments of the application, but as mentioned above, it should be understood that the application is not limited thereto. Any combinations, modifications and changes made without departing from the spirit of the invention, shall fall within the scope of the invention defined by the appended claims.

What is claimed is:

1. A bidirectional ship lift by gravity balancing, comprising a ship lift body;

wherein a first support is provided in a middle of the ship lift body; a second support is provided at a side of the first support; and a third support is provided at the other side of the first support;

a downstream approach channel is provided at a bottom of a side of the second support and a bottom of a side of the third support, respectively; and an upstream approach channel is provided at a top of a side of the second support and a top of a side of the third support, respectively;

a space between the second support and the first support forms a first shaft; a space between the first support and the third support forms a second shaft; a first ship-carrying chamber is provided in the first shaft; a second ship-carrying chamber is provided in the second shaft; and two transition ship chambers are respectively provided at a top of the first shaft and a top of the second shaft;

a top of the third support is provided with a first outer safety pincer installation groove, in which a plurality of first outer safety pincers are provided; a bottom of each first outer safety pincer is provided with a first outer fixed pulley; and a top of each first outer safety pincer is provided with a second outer fixed pulley;

a top of the second support is provided with a second outer safety pincer installation groove, in which a plurality of second outer safety pincers are provided; a bottom of each second outer safety pincer is provided with a sixth outer fixed pulley; and a top of each second outer safety pincer is provided with a fifth outer fixed pulley;

a top of the first support is provided with a tension device installation groove; a plurality of first inner fixed pulleys are provided at a bottom of a side of the tension device installation groove; and a plurality of fifth inner fixed pulleys are provided at a bottom of the other side of the tension device installation groove;

a bottom of each first inner fixed pulley is provided with a first inner safety pincer; and a bottom of each fifth inner fixed pulley is provided with a second inner safety pincer;

a second inner fixed pulley is provided at the bottom of the side of the tension device installation groove; and a plurality of bidirectional speed limiters are provided at the bottom of the other side of the tension device installation groove;

a top of the tension device installation groove is provided with an outer tension gear installation groove; a plurality of fourth outer fixed pulleys are provided at a bottom of a side of the outer tension gear installation groove; a plurality of third outer fixed pulleys are provided at a bottom of the other side of the outer tension gear installation groove; and a plurality of outer tension gears are provided in the outer tension gear installation groove; and an inner tension gear installation groove is provided at a bottom of the tension device installation groove; a plurality of third inner fixed pulleys are provided at a top of a side of the inner tension gear installation groove; a plurality of fourth inner fixed pulleys are provided at a top of the other side of the inner tension gear installation groove; and a plurality of inner tension gears are provided in the inner tension gear installation groove.

2. The bidirectional ship lift of claim 1, wherein a top of each outer tension gear is fixedly connected to an outer tension gear installation plate via bolts; an end of each of a plurality of first tension hydraulic cylinders is fixedly connected to a top of the outer tension gear installation plate; and the other end of each of the plurality of first tension hydraulic cylinders is fixedly connected to a top of the outer tension gear installation groove; and a bottom of each inner tension gear is fixedly connected to an inner tension gear installation plate via bolts; an end of each of a plurality of second tension hydraulic cylinders is fixedly connected to a bottom of the inner tension gear installation plate; and the other end of each of the plurality of second tension hydraulic cylinders is fixedly connected to a bottom of the inner tension gear installation groove.

3. The bidirectional ship lift of claim 1, wherein a plurality of trapezoidal screw installation grooves are provided at two sides of the first shaft and two sides of the second shaft, respectively; and each of a plurality of linear slide rail installation grooves is sandwiched between two adjacent trapezoidal screw installation grooves; and a plurality of trapezoidal screws are provided in the trapezoidal screw installation grooves; a plurality of screw motors are respectively provided at an end of each of the plurality of trapezoidal screws and are electrically connected to an external power supply; and linear slide rails are respectively provided in the linear slide rail installation grooves.

4. The bidirectional ship lift of claim 1, wherein a plurality of first outer holes are provided at a side of a top of the first ship-carrying chamber; and a plurality of first inner holes are provided at the other side of the top of the first ship-carrying chamber;

a plurality of second outer holes are provided at a side of a top of the second ship-carrying chamber; and a plurality of second inner holes are provided at the other side of the top of the second ship-carrying chamber; and the first outer holes, the first inner holes, the second outer holes and the second inner holes are provided for fixing steel cables.

5. The bidirectional ship lift of claim 4, wherein an end of each of a plurality of outer steel cables is fixedly connected to one of the second outer holes; and the other end of each outer steel cable passes through the first outer fixed pulley, one of the first outer safety pincers, the second outer fixed pulley, one of the third outer fixed pulleys, one of the outer tension gears, one of the fourth outer fixed pulleys, the fifth outer fixed pulley, one of the second outer safety pincers and the sixth outer fixed pulley in sequence, and then is fixedly connected to one of the first outer holes.

6. The bidirectional ship lift of claim 4, wherein an end of each of a plurality of inner steel cables is fixedly connected to one of the first inner holes; and the other end of each inner steel cable passes through the first inner safety pincer, one of the first inner fixed pulleys, the second inner fixed pulley, one of the third inner fixed pulleys, one of the inner tension gears, one of the fourth inner fixed pulleys, one of the bidirectional speed limiters, one of the fifth inner fixed pulleys, the second inner safety pincer in sequence and then is fixedly connected to one of the second inner holes.

7. The bidirectional ship lift of claim 4, wherein a plurality of tension sensors are respectively provided at bottoms of the first outer holes, the second outer holes, the first inner holes and the second inner holes;

two ends of each of a plurality of inner steel cables and two ends of each of a plurality of outer steel cables are fixedly connected to the tension sensors; eight speed sensors are respectively provided at four corners of the first ship-carrying chamber and four corners of the second ship-carrying chamber; eight acceleration sensors are respectively provided beside the eight speed sensors; eight lidar ranging sensors are respectively provided beside the eight acceleration sensors; and the eight speed sensors, the eight acceleration sensors, the eight lidar ranging sensors and the tension sensors are electrically connected to an external central control computer; and a plurality of water inlets and a plurality of water outlets are fixedly connected to an external water pump through water pipes; and a plurality of first tension hydraulic cylinders and a plurality of second tension hydraulic cylinders are fixedly connected to an external oil pump through oil pipes.

8. The bidirectional ship lift of claim 1, wherein a main ship chamber is provided in a middle of the first ship-carrying chamber and a middle of the second ship-carrying chamber, respectively; an entry water tank is provided at a side of the main ship chamber; and an exit water tank is provided at the other side of the main ship chamber;

a first entry flap gate is provided at a side of the entry water tank; and a second entry flap gate is provided at the other side of the entry water tank;

a first exit flap gate is provided at a side of the exit water tank; and a second exit flap gate is provided at the other side of the exit water tank;

a retractable block is provided at an outer side of the first entry flap gate, the second entry flap gate, the first exit flap gate and the second exit flap gate, respectively;

a barrier is provided at an inner side of the first entry flap gate, the second entry flap gate, the first exit flap gate and the second exit flap gate, respectively;

a plurality of water inlets are spacedly provided at a top of two sides of the entry water tank and a top of two sides of the exit water tank, respectively; and a plurality of water outlets are spacedly provided at a bottom of two sides of an inner wall of the entry water tank and a bottom of two sides of an inner wall of the exit water tank, respectively; and an anti-collision rubber is provided at two sides of an inner wall of the main ship chamber, respectively; and a standard waterline is provided on an outer surface of the anti-collision rubber.

9. The bidirectional ship lift of claim 1, wherein a plurality of screw nuts are spacedly provided at two sides of an outer wall of the first ship-carrying chamber and two sides of an outer wall of the second ship-carrying chamber; and each of a plurality of linear sliders is sandwiched between two adjacent screw nuts; and the screw nuts are threaded with the trapezoidal screws; and the linear sliders are in clearance fit with linear slide rails.

10. The bidirectional ship lift of claim 1, wherein a transitional main ship chamber is provided in a middle of each of the two transition ship chambers; two entry chutes are respectively provided at two sides of the transitional main ship chamber; two exit chutes are respectively provided at two sides of the transitional main ship chamber;

an entry gate is provided between the two entry chutes; and an exit gate is provided between the two exit chutes.

* * * * *